US005211700A

United States Patent [19]

McClellan

[11] Patent Number: 5,211,700

[45] Date of Patent: May 18, 1993

[54] MOVABLE DAM GATE FOR REGULATING WATER IN A NAVIGABLE PASS

[75] Inventor: Byron K. McClellan, Salem, Ind.

[73] Assignee: The United States of America as represented by the Secretary of the Army, Washington, D.C.

[21] Appl. No.: 880,636

[22] Filed: May 8, 1992

[51] Int. Cl.[5] ..... E02B 7/40

[52] U.S. Cl. ..... 405/99; 405/101

[58] Field of Search ..... 405/87, 99, 100, 101, 405/102

[56] References Cited

U.S. PATENT DOCUMENTS 2,051,359 8/1936 Adams ..... 405/101

2,335,327 11/1943 Wellons ..... 405/102

4,073,147 2/1978 Nomura ..... 405/101 X

*Primary Examiner*—David H. Corbin

*Attorney, Agent, or Firm*—Luther A. Marsh

[57] ABSTRACT

A wicket gate for providing a dam in a navigable waterway is described. A wicket gate is connected at one end to an axle which permits rotation of the wicket gate from a horizontal to a vertical position. The axle is supported on first and second carrier bearing, connected to a concrete sill within the navigable waterway. The wicket gate may be raised and lowered by a motor located within a gallery of the concrete sill. The motor is connected via a drive shaft to the axle of the wicket gate. This structure permits movement of the gate without props or other protrusions which could collect and hold debris.

1 Claim, 2 Drawing Sheets

MOVABLE DAM GATE FOR REGULATING WATER IN A NAVIGABLE PASS

The present invention relates to movable dam gates which permit control over the level of a body of water. Specifically, a movable dam gate comprising a wicket gate which can be lifted from the horizontal position to a vertical position via an electric control signal is described.

Dam gates are used to control the level of water in navigable streams. These streams, such as the Ohio River, have a varying water flow level, depending on the time of year and the amount of rainfall received during the preceding year. In order to maintain the level of the river so that it is navigable at all times, various dam structures have been constructed to maintain the level constant, independent of rainfall and other natural conditions.

These gates must be raised and lowered to maintain a sufficient water level during the summer months, and to prevent excessive water level during the months of heavier rainfall. Thus, the dam gates will be raised and lowered to maintain a constant level of water in the navigable stream.

The procedure for raising and lowering these dam structures is tedious. Presently, existing wicket-type gates which are deployable from a horizontal, high-water position to a vertical low-water position utilize a prop or operating strut attached to the downstream side of the wicket. The gate is raised or lowered into position with a boat or bridge mounted hoist, or a hydraulic cylinder located on or in the dam sill. The presence of ice and high velocity water can render operation of the gate dangerous to personnel who must operate the hoist or remove debris. Additionally, hydraulic cylinders located in wet recesses may be subject to severe environmental conditions. Lowering the gate may require removal of debris and sand which accumulate around the strut and would otherwise prevent the gate from assuming its horizontal recessed position.

SUMMARY OF THE INVENTION

It is an object of this invention to provide a wicket gate dam which can be raised and lowered with minimum inconvenience and danger to operating personnel.

It is a further object of this invention to provide a wicket gate having a failsafe device which will void the destruction of the wicket if it is inadvertently struck by a vessel.

These and other objects of the invention are provided by a wicket dam gate which is connected at one end to an axle. The axle is supported along a concrete sill on two or more support bearings. The two support bearings hold the axle which is driven at approximately its central location by a gearbox coupled to a gear on the axle.

Located within the concrete sill is a dry gallery which will support a motor and clutch assembly. The motor is connected to the gearbox through the clutch assembly and a braking device. As power is applied to the hydraulic motor, it is possible to raise and lower the wicket from a horizontal position within a recess along the top of the concrete sill to a 90° vertical position.

The slip clutch in the preferred embodiment of the invention operates as a failsafe device such that when the wicket is inadvertently struck by a vessel, or other material floating in the navigable water, the wicket will deflect towards its horizontal position, as the slip clutch will give when the load exceeds a predetermined maximum against the wicket gate.

The raising and lowering operation of the wicket can be from on shore, using electrical cables connected to the motor and a shore location which will energize and deenergize the motor during a raising and lowering operation.

DESCRIPTION OF THE PREFERRED EMBODIMENT

Figure 1:
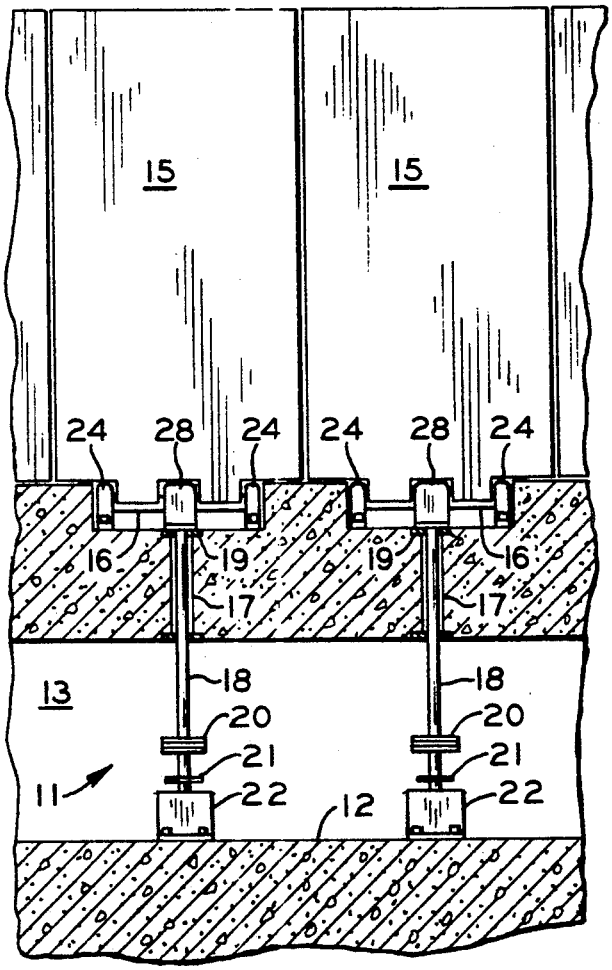
FIG. 1 is front sectional view, illustrating a combination of wicket gates 15 supported on a concrete sill 11.

Referring now to FIG. 1, there is shown a pair of wicket gates 15, each in a vertical position for providing maximum upstream water depth. FIG. 1 shows a section view of a concrete sill 11 which is formed to support each of the wicket gates 15. The preferred embodiment contemplates a plurality of such wicket gates, each deployed side by side the required length of a dam across a navigable waterway. The wicket gates 15 are connected to an axle 16, the axle 16 in turn supported in a channel of the concrete sill by a pair of carrier bearings 24 and the gearbox 28.

Figure 2:
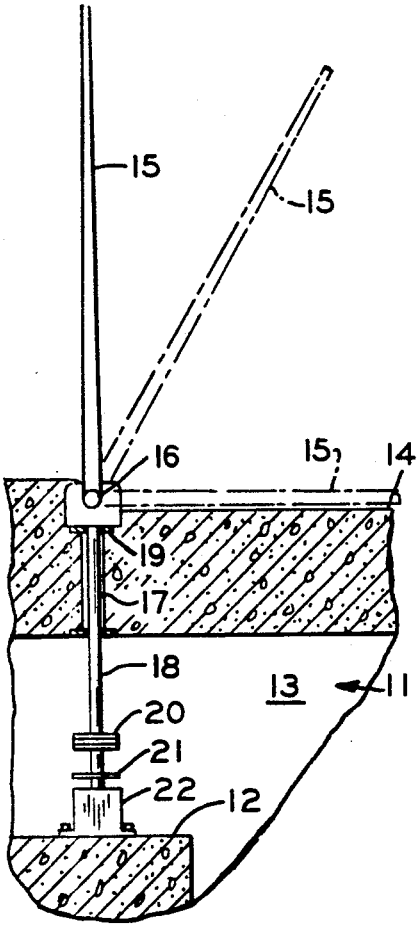
FIG. 2 is a side view of one of the wicket gates of FIG. 1.

As can be seen from FIG. 2, the wicket gate 15 can assume a horizontal position, constituting the minimum dam height during periods in which the stream height is adequate for navigation. The wicket gate 15 in the horizontal position is within a recess 14 of the concrete sill 11.

The wicket gate 15 is moved between the horizontal and vertical positions by a gearbox 28, which provides torque to the axle 16. As can be seen from FIG. 1 and 2, there are no struts, props or other elements which would tend to collect debris and otherwise prevent the gate 15 from being moved to its horizontal position against the recess 14 or to its vertical position, as shown. The gate 15 and axle 16 are of unitary construction, and can be removed as a single unit for maintenance and replacement.

The wicket gates can be constructed of materials such as steel, stainless steel, aluminum or concrete (reinforced or prestressed). The wicket gates could be up to 20 feet in width. Preferably, the gates 15 are welded to the respective axle 16 to withstand the loading of the dammed water supply or withstand any sudden forces, such as an inadvertent collision with moving objects in the stream.

The concrete sills 11 are formed in the riverbed, and would include a dry gallery 13 for supporting a motor 22 connected to a respective drive shaft 18. The drive shaft 18 is connected through a sleeve 17 to the gearbox 28.

Each of the gearboxes 28 includes a set of gears for transferring torque from the drive shaft 18 to the axle 16. Conventional seals 19 are provided to keep the water from entering the dry gallery 13. A ledge 12 within the dry gallery 13 supports the motors 22 and respective torque coupling devices.

One of the torque coupling devices is a clutch 20 which is provided to release the dam gate 15 in the event of a collision with a floating object. Should a ship, or other floating object, hit the wicket gate 15 in its extended position, the clutch 20 would permit the gate 15 to move towards its horizontal position, thus avoiding breaking the coupling between the motor 22 and the gearbox 28. In this way, the clutch 20 provides a failsafe operation to avoid the catastrophic collision with the extended wicket gate 15. A brake 21 is shown which will permit dogging of the drive shaft 18, permitting the gate 15 to be moved in distinct increments between the vertical and horizontal positions.

The motor 22 for each of the wicket assemblies will provide the mode of force for moving the wicket gate 15 between its horizontal position against the sill recess 14 to its vertical position 15.

Each of the bearings 24 may include a greaseline for maintaining the bearings lubricated from a source of lubricating grease.

In operation, the motors 22 can be activated via source of electrical current on shore, so as to move the wicket gates 15 between their most horizontal position within the tapered recess 14 to its most vertical position. The operation can be carried out without personnel on the river at the time, and without concern for debris catching and collecting along structures associated with the dam as in the prior art, which would thereby require the debris to be removed.

Figure 3:
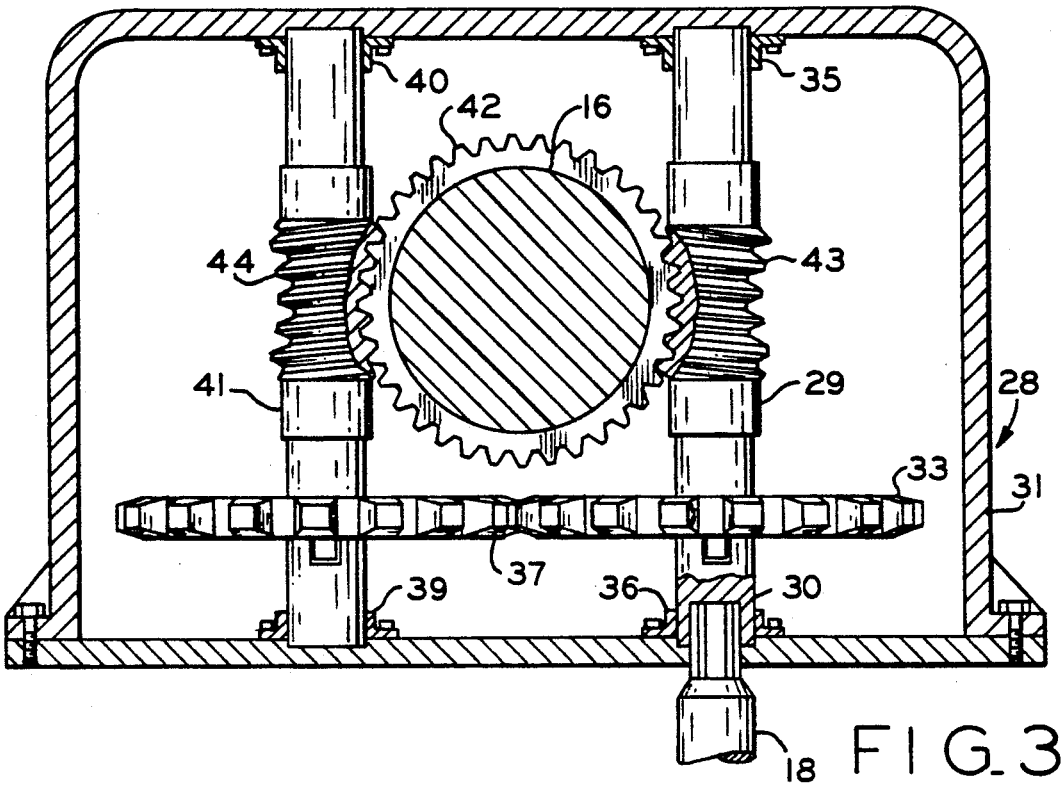
FIG. 3 is a lateral view of the gearbox 28 which couples the axle 16 of wicket gate 15 to a drive shaft 18.
Figure 4:
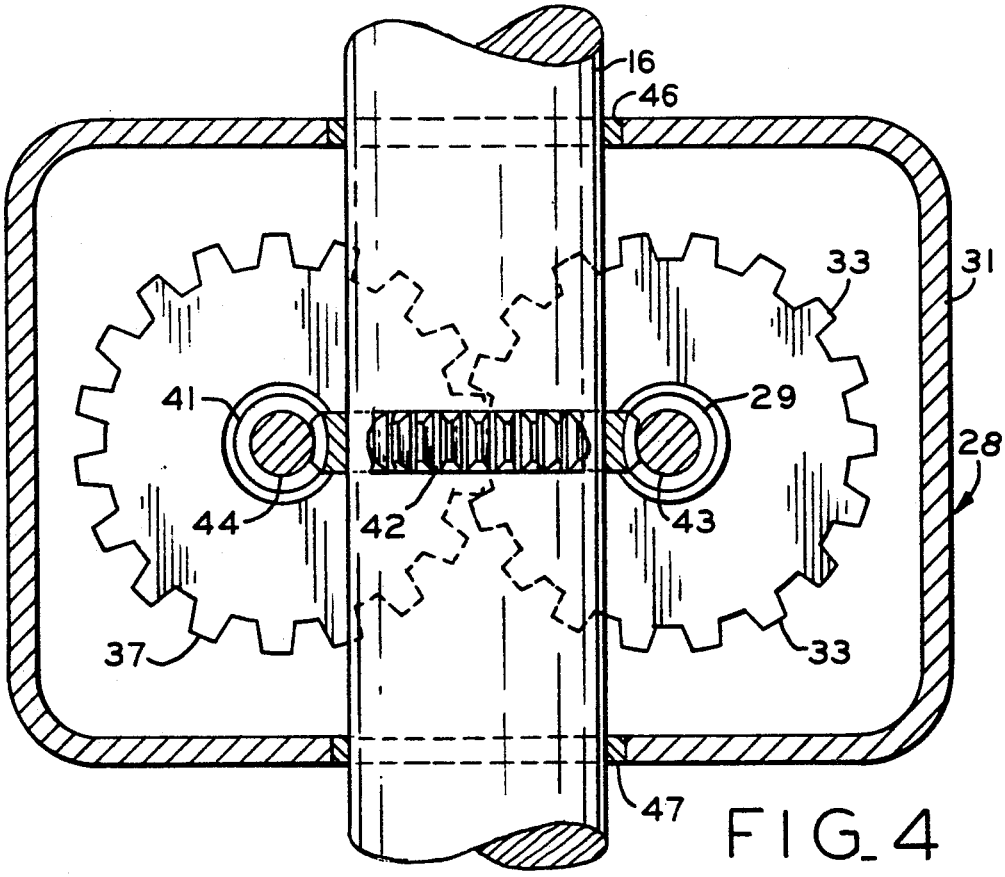
FIG. 4 is a top view of the gearbox of FIG. 3.

FIGS. 3 and 4, show in detail gearbox 28, for transferring torque from the driveshaft 18 to the axle 16. The gearbox 28 includes a housing 31 supporting first and second worm gears 29 and 41 for rotation. Each of the worm gears are held at respective ends by bearing supports 35 and 36, and 39 and 40. The worm gear 29 includes at one end thereof a spline coupling 30, connecting the worm gear 29 to the drive shaft 18. The worm gears 29 and 41 further include a reversing gear 33 assembly comprising gears 33, 37 for coupling the torque to the second worm gear 41. Thus, torque from the drive shaft 18 is coupled to the first and second worm gears 29 and 41, rotating the same.

The gear teeth 43 and 44 of the respective worm gears engage teeth of a gear 42 which is rigidly connected to the drive shaft 16. The rotation of each of the worm gears 29 and 41 imparts the torque received from the drive shaft 18 to the axle 16, permitting the axle 16 to rotate, which raises and lowers the wicket gate 15.

In operation, power to each of the motors can be controlled on shore, as well as the direction of motor operation. The brake 21 will hold the gate in the position selected by the operator, once the power is de-energized from the motor. As has been mentioned, the clutch 20 prevents any sudden force applied to the wicket 15 from breaking the coupling between the axle 16 and the motor 22 by permitting relative movement of the wicket gate 15.

Thus, there has been described with respect to one embodiment, a wicket gate dam structure which avoids the inconvenience and danger associated with prior art dam gate operation. The wicket gate can be safely positioned from shore. Further, the structure has been designed to minimize any debris-collection or necessity to have personnel at the gate site during movement of the wicket gate. Those skilled in the art will recognize yet other objects of the invention described by the claims which follow.

What is claimed is:

1. A movable dam gate comprising:

a concrete sill supporting an axle for rotation, said sill having a dry gallery located there within for supporting a hydraulic motor and clutch assembly and said sill having a tapered recess along it top for supporting a wicket gate in a fixed position;

a wicket gate further supported at one end of said axle, said axle being rotatable to position said wicket gate between vertical position and a horizontal position;

a hydraulic motor and clutch assembly located in said dry gallery in said sill, having a drive shaft extending through said sill to said axle and having a brake connected, thereto for holding said wicket gate in a horizontal position and said clutch being a slip clutch which operates as a failsafe device such that when the wicket is struck and a predetermined amount of pressure is placed thereupon, said slip clutch will give and said wicket will deflect towards its horizontal position; and a gearbox connecting said drive shaft to said axle whereby said wicket gate may be positioned between a vertical and horizontal position by operation of said hydraulic motor and clutch assembly.

* * * * *